United States Patent [19]

Franzen et al.

[11] Patent Number: 4,882,484

[45] Date of Patent: Nov. 21, 1989

[54] METHOD OF MASS ANALYZING A SAMPLE BY USE OF A QUISTOR

[75] Inventors: Jochen Franzen; Reemt-Holger Gabling, both of Bremen; Gerhard Heinen, Grasberg; Gerhard Weiss, Weyhe, all of Fed. Rep. of Germany

[73] Assignee: The United States of America as represented by the Secretary of the Army, Washington, D.C.

[21] Appl. No.: 265,108

[22] Filed: Oct. 31, 1988

[51] Int. Cl.[4] ..... H01J 49/42

[52] U.S. Cl. ..... 250/282; 250/290; 250/291; 250/292

[58] Field of Search ..... 250/282, 290, 291, 292

[56] References Cited

U.S. PATENT DOCUMENTS 4,540,884 9/1985 Stafford et al. ..... 250/282

4,749,860 6/1988 Kelley et al. ..... 250/282

*Primary Examiner*—Jack I. Berman

*Attorney, Agent, or Firm*—Robert P. Gibson; Edward Goldberg; Michael C. Sachs

[57] ABSTRACT

In a quadrupole ion store (QUISTOR), a sample is analyzed by increasing the amplitude of the harmonic, or "secular", oscillations of selected stably trapped ions so that they leave the trapping field. In a preferred embodiment, deviations from the ideal electrode geometry are incorporated into the QUISTOR to produce resonance phenomena between the r and z secular oscillations, thereby increasing the amplitude of oscillations in the z direction.

10 Claims, 7 Drawing Sheets

METHOD OF MASS ANALYZING A SAMPLE BY USE OF A QUISTOR

GOVERNMENT INTEREST

The U.S. Government has rights in this invention pursuant to contract number DAAA-15-87-C-0008 awarded by the Department of the Army.

BACKGROUND AND FIELD OF THE INVENTION

The present invention is directed to a method of analyzing a sample by use of a QUISTOR mass spectrometer.

The "QUISTOR" (QUadrupole Ion STORe") or "ion trap" can store ions of different mass-to-charge ratios simultaneously in its radio-frequency hyperbolic three-dimensional quadrupole field.

The QUISTOR consists of a toroidal ring electrode and two end cap electrodes. A high RF voltage of amplitude $V_{stor}$ and frequency $f_{stor}$ is applied between the ring electrode and the two end caps. Both end cap electrodes normally are connected to the same potential. The radio-frequency voltage across the electrodes forms, at least near the center of the QUISTOR, a hyperbolic three-dimensional quadrupole field which is able to trap ions.

Cylindrical coordinates are used to describe the QUISTOR. The direction from the center towards the saddle line of the ring electrode is called the r direction or r plane. The z direction is defined to be normal to the r plane.

The ion oscillations by the RF field cause, integrate over time, a resulting force towards the center, and proportional to the distance from the center. This quasi-elastic central force field forms, integrated over time, an harmonic oscillator for the ions. The relatively slower harmonic oscillations around the center are superimposed by the faster impregnated RF oscillations.

The harmonic oscillations are called the "secular" oscillations of the ions within the QUISTOR field.

The exact mathematical description of the movements of ions in a QUISTOR is difficult. Up to now, a solution of the resulting partial equations was only possible for the special case of independent secular movements in r and z directions. The solution of the corresponding "Mathieu"'s differential equations results in an "ideal QUISTOR" of fixed design: The slope of the asymptotic cone envelope has the "ideal angle" z/r=1/1.414 (1.414=square root of 2).

Most of the QUISTORs which have been built up to now, follow the design principles of such an "ideal QUISTOR" with hyerbolic surfaces and the above "ideal" angle z/r, although it has been shown experimentally that QUISTORs of quitely different design, e.g. with cylindrical surfaces do store ions by no means less effective.

In the special case of an "ideal QUISTOR", the secular oscillations are, by the inherent mathematical assumptions, independent, and different, in r and z directions. The stability area boundaries for the ion movements in the well-known a/q diagram can be calculated. The stability area is formed by a net of $beta_r$ lines ($0<beta_r<1$) and crossing $beta_z$ lines ($0<beta_z<1$). The beta lines describe exactly the secular frequencies:

$$f_{sec,r}=beta_r * f_{stor}/2;$$

$$f_{sec,z}=beta_z * f_{stor}/2.$$

LIST OF FIGURES

FIG. 1 Stability area for an "ideal" QUISTOR in the $a_z/q_z$ diagram.

FIG. 2 Designation of the inscribed radii and pole distances.

FIG. 3 Mass resolution of the excitation frequency upwards scan (Single shot). A resolution of r=1200 was achieved.

FIG. 4 Portion of a RF voltage amplitude V scan with a non-ideal QUISTOR. Shown here is a single shot. A CI spectrum of acetone, toluene, and tetrachloroethene was chosen. The full spectrum covered the mass range from 39 u to 500 u, and was measured in 33 milliseconds. The 25 spectra/second repetition rate left time for 250 microseconds of quenching, 1 millisecond ionization, and 5 milliseconds CI reaction.

FIG. 5 The molecular ion groups of tetrachloroethene, enlarged from FIG. 4.

FIG. 6 Single shot enlargement of the molecular ion groups from tetrachloroethene. EI ionization, spectra repetition rate 100 spectra/second. Spectrum was taken in 8 milliseconds from mass 30 u to mass 180 u.

FIG. 7 Design of a best QUISTOR.

DETAILED DESCRIPTION OF THE INVENTION

Figure 1:
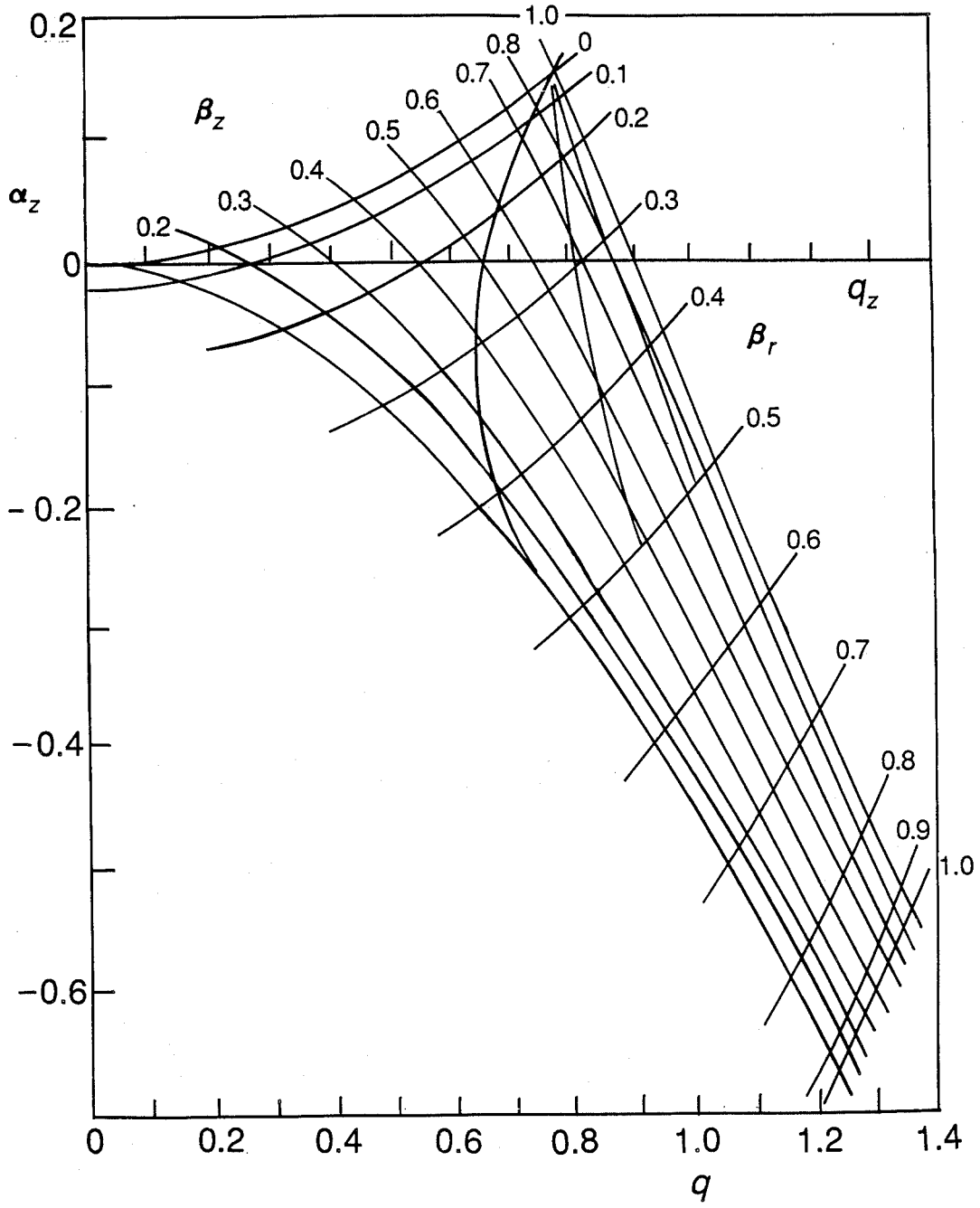

In FIG. 1, the stability area for an "ideal QUISTOR" is shown in the $a_z/q_z$ diagram, together with the iso-beta lines.

For a given ion of mass-to-charge-ratio m which is stored inside the stability boundaries given by the operating conditions a and q, there exists a unique secular frequency $f_{sec,z,m}(a,q)$ in the z direction and a (usually different) unique secular frequency $f_{sec,r,m}(a,q)$ in the r direction.

"Non-ideal QUISTORs" which are not built according to above ideal design criteria, or which show a lack of precision in production, do not have independent r and z secular motions. In this case, the secular oscillations in one direction are coupled with the above secular oscillations in the other direction. The secular movements influence each other mutually, and, as it is known from coupled oscillators, resonance phenomena appear. Depending on the type of field distortions, several types of "sum resonances" or "coupling resonances" exist in a QUISTOR.

Up to now, these resonances were only investigated and described for the cases of superimposed weak multipole fields. If the quadrupole field is superimposed by a weak multipole field, with one pole fixed in z direction, the conditions for sum resonances are:

| Type of field | most prominent resonance condition | Order of potential terms |
|---|---|---|
| quadrupole field: | none | second order, no mixed terms |
| hexapole field: | $beta_z + beta_r/2 = 1$ | third order with mixed terms |
| octopole field: | $beta_z + beta_r = 1$ | fourth order, with mixed terms and with equal signs for $r^4$, $z^4$ |
| dodecapole field: | $beta_z/2 + beta_r = 1$ | sixth order with mixed terms |

Each electrical field is a first derivation (after r and z) of the electrical potential. The mathematical expression for the electrical quadrupole potential contains only quadratic terms in r and z, and no mixed terms. In the case of multipoles, however, terms of higher order and mixed terms appear. The mixed terms represent the mutual influence of the secular movements, and the terms of higher order than 2 represent non-harmonic additions which make the secular frequencies dependent on the amplitude of the secular oscillations.

The trapping field in the center of the QUISTOR naturally is mostly influenced by the shape of those parts of the electrodes which are nearest to the center. Thus the curvature across the saddle line of the ring electrode, and the curvature at the summit of the end caps influences mostly the trapping field. These curvatures can be described by inscribed circles with radii $R_r$ for the ring, and $R_e$ for the end caps. (In fact, a QUISTOR can be built by an O-ring shaped ring electrode, and two spheres as end caps, just equivalent to a quadrupole mass filter which may be successfully built from four cylindrical rods).

Figure 2:
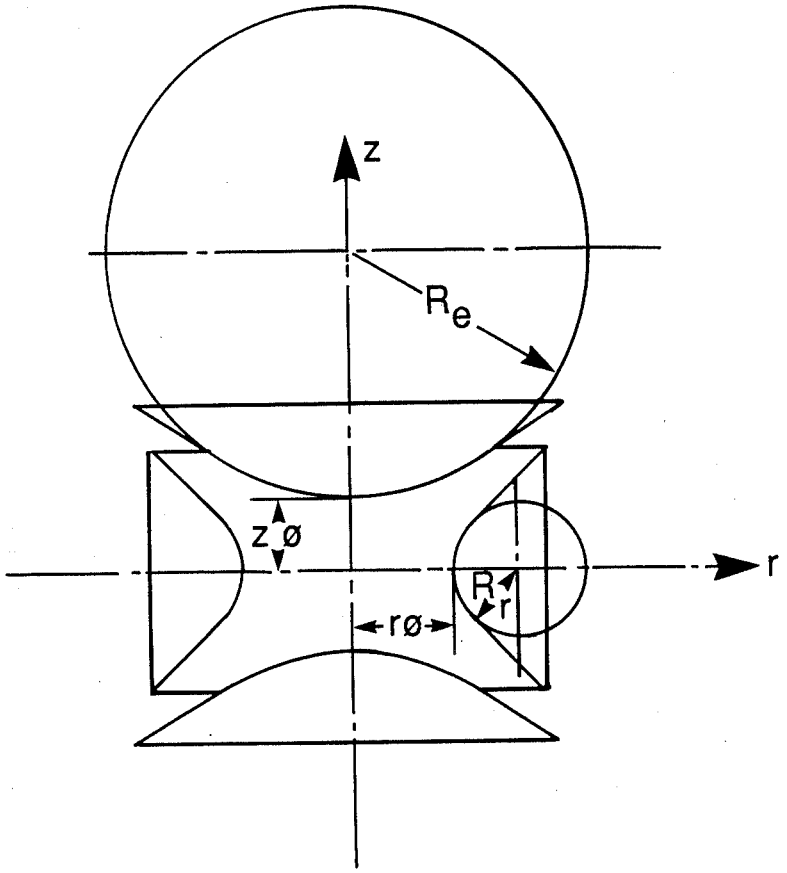

The ideal QUISTOR is characterized by the following condition for the distance-corrected ratio Q of the inscribed radii (FIG. 2):

$$Q = \frac{R_e}{R_r} * \frac{r_0}{z_0} = 4.000 \text{, where}$$

$R_r$=radius of the ring electrode in the points nearest to the field center $R_e$=radius of the end electrodes in the points nearest to the field center $r_O$=smallest distance of the ring electrode from the field center $z_O$=smallest distance of the end electrodes from the field center.

If a non-ideal QUISTOR has end and ring electrodes which are both too "sharp" (the radii $R_r$ and $R_z$ are both too small), or both too "blunt" (the radii are both too large compared with an ideal hyperbolic QUISTOR), its field can be described as a quadrupole field, distorted by the superposition of an octopole field. This is one of the most likely field distortions for QUISTORs.

If in such a case, for a given ion mass m, the above sum resonance condition for octopoles is valid, the ion starts to resonate in the field and to take up energy from the RF field in both z and r directions. The oscillation amplitudes increase in both directions. Since the fourth order terms have the same sign in both directions, the frequencies of the oscillations in both directions either increase together, or decrease together. In both cases, the resonance condition is no longer fulfilled, and the resonance stops. This behavior can easily be studied by simulations. Other types of distortions by single multipoles show similar effects.

The quadrupole field can also be distorted by a too blunt end cap curvature, and a too sharp ring electrode curvature (Q>4.000), or vice versa (Q<4.000). Most prominent additional terms for the electrical potential are pure and mixed terms of the fourth order in r and z, in the case of superimposed octopoles, but with different signs in the r and z directions. The resonance condition is $beta_z+beta_r=1$.

This exhibits two remarkable features:

First, if an ion fulfills the resonance condition, it starts to resonate. But the secular oscillations grow only in one direction, the amplitudes in the other direction decrease towards zero. If the amplitude grows in the z direction, the ions are thus focussed towards the center of the end caps.

Second, the ions stay for a longer time in resonance. Whereas the oscillation frequency increases in the z direction, it decreases in the r direction. In first approximation, the sum of both frequencies remains constant, and the resonance condition remains fulfilled over a longer period of time.

A similar behavior is known from coupled oscillators, where a small fraction—or, in resonance, the total amount—of the kinetic energy of the movement starts to swing from one oscillating state to the other (and back), increasing and decreasing the movement amplitude of the respective oscillations.

Presently known QUISTOR scan methods with ion ejection:

Up to a few years ago, the QUISTOR was operated mostly in the so-called "mass selective ion storage mode". After each ionization period, only a preselected single kind of ions was stored by applying corresponding operating conditions near the tip of the stability region, and was subsequently measured by ejection through one of the end caps. A spectrum was acquired by frequent repetitions of this procedure with slightly altered storage conditions for the storage and subsequent detection of other ion masses.

In the context of the present invention, this method will not be regarded as a "scan" method. Scan methods in our sense measure the ions through a wide range of ion masses which are stored simultaneously in the QUISTOR, generated in a single ionization process.

Up to now, the "mass selective instability ejection method" is the ion ejection scan method used.

In its simplest form, the method operates the QUISTOR along the line a=0 only, i.e., the QUISTOR is driven in the "RF only" mode without applying a superimposed DC voltage. In this mode, theoretically all ions can be stored within the QUISTOR above a lower cut-off mass. The cut-off ion mass is given by the limit of the stability area on the q axis:

$$m_{cut\text{-}off} = -\frac{4 * e * V_{stor}}{q_{z,1} * r_0^2 * w2} \text{, where}$$

$q_{z,1}$=0.91 limit of the stability area for a=0, (characterized by $beta_z=1$)

e charge of the electron $V_{stor}$ peak amplitude of the basic RF voltage $r_O$ inner radius of the ring electrode $w=2*pi*f_{stor}$ angular frequency of the basic RF voltage As can be seen, $m_{cut\text{-}off}$ at the border of the stability area is directly proportional to the amplitude $V_{stor}$ of the basic RF voltage. By scanning $V_{stor}$ to higher values, the storage condition for one ion mass after the other shifts across the stability limit and the movement of the ions becomes unstable. It is of interest to note that only the ion movement in the z direction becomes unstable ($beta_z>1$). The secular oscillations in the r direction remain stable ($beta_r=0.34$). Thus the ions do not longer encounter a backpulling central force in the z direction. In contrast, in the z direction the averaged central force reverses its direction and the ions are driven against the end caps of the QUISTOR.

If the tip of one of the end caps is perforated, a fraction of the ions may penetrate through the perforations and can be detected outside the QUISTOR by well-known mass spectrometric means, e.g. by a secondary electron multiplier.

This scan method, however, has two severe fundamental drawbacks:

First, only a small part of the ions hits the perforations in the center of the end cap, whereas a major part of the ions hits the end cap far off from the z axis. The secular frequency movement of the ions in the r direction makes the probability very small that an ion resides, at a given time, near the z axis. It is a difficult task to increase the perforated area and to focus the penetrating ions onto the detection device. Due to the high RF peak voltages $V_{stor}$, the ions partially have very high kinetic energies (up to 1000 eV and more) when they leave the QUISTOR, and a simultaneous focusing of all ions is thus impossible.

Second, ions very near to the center of the field do not see very much of a field because the field in the center is exactly zero. Ions near the center do not leave the QUISTOR, unless they are hit by another particle, leave the center under the effect of the pulse transfer, encounter a destabilizing field outside the center, and mover towards one of the end caps. (In fact, not only the ions near the center are not ejected immediately, but all ions which move almost inside the r plane). At low pressures within the QUISTOR, this process of kicking the ions out of the r plane take time. At a given scan speed, on the other hand, a long time to leave decreases the spectral resolution.

Both problems connected with these drawbacks can be at least partially overcome by the introduction of a damping gas. A damping gas (e.g. Helium) increases the spectrum resolution and the ion yield considerably. Both effects can be explained by the above considerations. On one hand, the secular movements are damped, and the ions are concentrated near the center. On the other hand, frequent collisions of particles do not allow for long ion residing periods in the field-free center or in the r plane which is free of z field components.

For a QUISTOR with radius $r_O=1$ cm, and a storage frequency of 1 MHz, the optimum pressure for Helium as a damping gas seems to be very near to $1.5 * 10^{-3}$ mbar, and the corresponding minimum leaving time for 95% of the ions of one mass during a linear $V_{stor}$ scan is about 200 microseconds.

It is an objective of the present invention to improve the scan technique and to eliminate the severe drawbacks of the presently known scanning method by ion ejection. The present invention deals with a new scanning method by "mass selective resonance ejection" of ions by making use of the resonance of the secular movements in an exciting field. In contrast to the "mass selective instability ejection", this "mass selective resonance ejection" takes place inside the ion stability region, usually even from such spots inside the stability area where the ion storage stability is especially large. (The storage stability may be defined as resistance against defocusing DC fields). The stability diagram (FIG. 1) reveals that at $q_z=0.78$ the point of maximum stability can be found because here positive or negative DC voltages of maximum strength can be applied without destroying the storage capability for the respective ions). During the mass selective resonance ejection, the ion movements never become unstable but the amplitude of the movements is increased steadily by the resonance effect.

The scan method by "mass selective resonance ejection" needs additional electrical circuitry: An excitation RF voltage with frequency $f_{exc}$ has to be applied across the end caps of the QUISTOR. In the mass selective resonance ejection scan, the excitation voltage frequency $f_{exc}$ must match the z direction secular frequency $f_{sec,z}$ of the ions to be ejected. The ions then take up energy from the excitation field, their movement amplitude in the z direction increases, and they finally hit the end plates. If these are perforated, a fraction of the ions penetrates and can be detected outside the QUISTOR as described above for the case of mass selective instability ejection. This "mass selective resonance ejection" eliminates one of the two fundamental drawbacks of the "mass selective instability method". Ions near the center of the field and within the r plane see the full excitation voltage and start immediately to oscillate in the z direction. The ejection, therefore, is much faster in the resonance ejection mode. The average leaving time is about 120 microseconds, the scan speed, therefore, can be made considerably faster than for the mass selective instability ejection. The line shape of the mass selective resonance ejection is by far better than that of the mass selective instability ejection, since the tailing of the slowly leaving ions from the center lacks completely.

There are several possibilities to scan over subsequent ion masses. The two simplest methods are, first, to scan the excitation frequency $f_{exc}$ at fixed RF voltage amplitude $V_{stor}$, and, second, to scan the RF voltage amplitude $V_{stor}$ at fixed excitation frequency fexc.

The excitation frequency scan action scans the excitation frequency $f_{exc}$ either upwards from 0 to $f_{stor}/2$ or downwards from $f_{stor}/2$ to 0. The upwards scan action scans the masses down from infinity to $m_{cut\text{-}off}$, whereas the downwards scan ejects the masses upwards.

In both scan directions, the excitation frequency scan exhibits some minor drawbacks. First, the scan exhibits excellent results only in small mass ranges because there exist several resonances of the secular frequencies along the scan. Second, the masses are not linearly dependent on the frequency. It is not even possible to calculate the mass scale in a simple way since the relationship between $q_z$ (proportional to 1/m) and betaz (proportional to $f_{exc}$) cannot be expressed by an explicit analytical expression. Of course, the computability of the mass scale plays a minor role only because in practice the mass scale is calibrated experimentally. It is , however, useful to start the calibration from a theoretical curve.

These two minor drawbacks makes this type of scan less favorable then the scan of the RF voltage $V_{stor}$.

The RF voltage amplitude scan with fixed excitation frequency $f_{exc}$ can only be performed in one direction: Since the instability border of the stability diagram follows the resonance ejection in a fixed mass relationship, the scan cannot, for obvious reasons, be carried out in the other direction.

This type of scan has some advantages over the excitation frequency scan: The mass scan is theoretically linear with the scan parameter $V_{stor}$, and the scan works equally well over the whole range of stored masses.

The second fundamental drawback of the mass specific instability ejection, the low yield of ions through the small perforated area of the end caps is not yet eliminated.

Both types of scan, however, can be still improved considerably if the QUISTOR has field faults which result in non-harmonic oscillations. Scan speed and scan direction then show a marked influence onto the quality and resolution of spectrum peaks.

In such a non-harmonic QUISTOR the frequency of the secular oscillations change with the amplitude of the oscillations. If an ion increases its secular frequency with amplitude (positive terms of the fourth order), it will only stay in resonance with the exciting voltage for a longer period of time, if the frequency of the exciting field increases at the same speed during the scan. if- the correct scan speed is applied, there is a typical double resonance effect: the secular frequency is in resonance with the exciting frequency, and the increasing rate of the secular frequency is in resonance with the scan speed.

Figure 3:
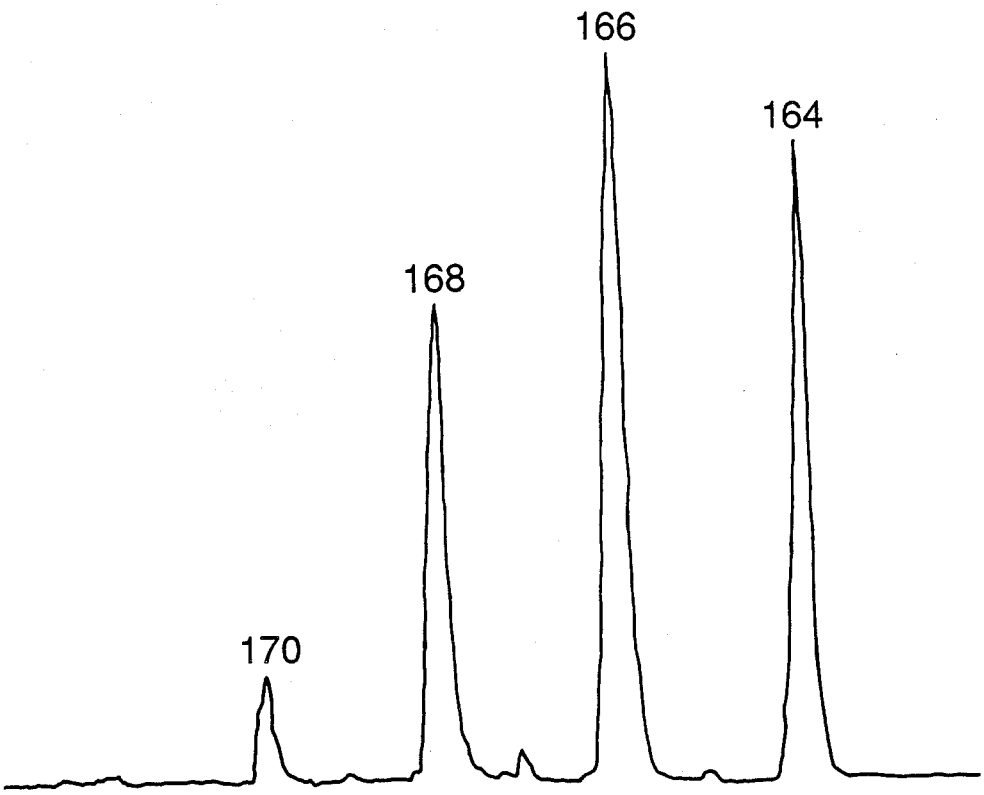

Using a QUISTOR with such field distortions, the excitation frequency upwards scan gives experimentally by far the better results than the downwards scan. Spectrum resolution and ion yield are significantly better. A resolution in excess of R=1200 has been achieved over small mass ranges (FIG. 3). The downwards scan with the same QUISTOR did not show a resolution better than 1/10 of the above value.

Naturally, this type of resonance is not as sharp as the resonance of the secular frequency with the excitation frequency because the scan speed has to hold the ion within resonance for a short period of time only. The resonance maximum is very wide, and deviations by a factor of two do not seriously destroy the effect. This type of scan may be called "mass selective double-resonance scan".

A further enhancement of the RF voltage scan, however, is possible by making use of specific natural resonances in a non-ideal QUISTOR. This type of scan may be designated as "mass selective triple-resonance ejection".

As described above, field faults of the fourth order produce a coupling resonance effect between the secular oscillations in the r and z directions at the location $beta_z+beta_r=1$. If the distortions are produced by a QUISTOR obeying one of the conditions for the distance-corrected ratio Q of the inscribed pole radii $$Q<4.000 \text{ or } Q>4.000,$$

resonating ions see an increase of their secular movement amplitude in the z direction, and a decrease in the r direction. Thus the ions are focussed in the z direction during z ejection, and are ideally suited for a high-gain ejection through a small perforated area at the tip of one of the end plates.

It is now possible to apply the mass selective resonance ejection with fixed excitation frequency and RF voltage amplitude scan to such a QUITOR with such field distortions of the fourth order, to tune the excitation frequency exactly into the coupling resonance, and to adjust the scan speed to keep the ions in resonance.

Three resonance phenomena appear simultaneously:

First, the resonating ions take up energy from the exciting field and increase their oscillation amplitudes in the z direction.

Second, the ion movement in the z direction gains additional energy from the coupled movement in the r direction. The ions are gathered near the z axis. The secular frequency of the ions becomes slower in the z direction, and higher in the r direction, and the condition $beta_r+beta_z=2$ remains nearly fulfilled by a partial compensation. The compensation, however, is only nearly exact, if the amplitudes are similarly large. If the r amplitude is small, the r secular frequency changes only very slowly, and the compensation stops. This resonance concentrates the ions near the z axis and increases largely the ion gain.

Third, the $V_{stor}$ upwards scan increases the secular frequencies of a given ion. This compensates the decreasing secular frequency in the z direction which stems from the increasing amplitude. If the scan speed is correctly chosen, the ions are held in resonance with the exciting frequency.

In a well tuned system, the ions leave the QUISTOR very near to the z axis. Almost all the ions penetrate the perforations at the tip of the end cap. To direct the ions to the correct end cap, a field fault of third order might be introduced, or a small DC voltage may be applied between the both end caps, in addition to the exciting frequency. The ion yield supercedes that of the damping gas optimized mass selective instability ejection scan by a factor of more than ten, i.e., this type of triple resonance scan makes a tenfold better use of the ions stored in a QUISTOR.

The time to leave the QUISTOR is extremely short in the case of the triple resonance: We were able to produce, with a QUISTOR of selected design, completely resolved spectra at scan speeds of one mass unit in 20 microseconds only, i.e., all ions of a given mass-to-charge ratio are ejected in 20 periods of the basic RF voltage only, or in only 7 oscillations of the secular frequency. This is about ten times faster than the maximum speed for the "mass selective instability ejection scan", each scan exhibiting tenfold the gain.

There is another big advantage of this triple-resonance scan: it is such less dependent on kind and pressure of the damping gas. It works in the usual mass spectrometric vacuum pressure range from best vacua up to $4*10^{-4}$ millibar. Above this limit, the spectral lines tend to broaden, as is known from normal quadrupole mass spectrometers. Normal air may be used as damping gas.

Besides lesser dependence on the damping gas, higher yield, faster scan rates, and better line shape, the triple-resonance ejection scan possesses still another advantage over the mass selective instability ejection scan: It needs lower RF voltage amplitudes V for the ejection of the same masses. The mass instability limit is characterized by $q_{z,1}=0.91$, whereas the triple resonance value is $q_{z,reson}=0.82$. Since the q values are reversely proportional to the masses, the triple-resonance scan needs a voltage lower by about 9% for the same mass. This is a considerable advantage because the generation of the high-voltage RF is one of the most difficult tasks in the design of QUISTORs.

Figure 4:
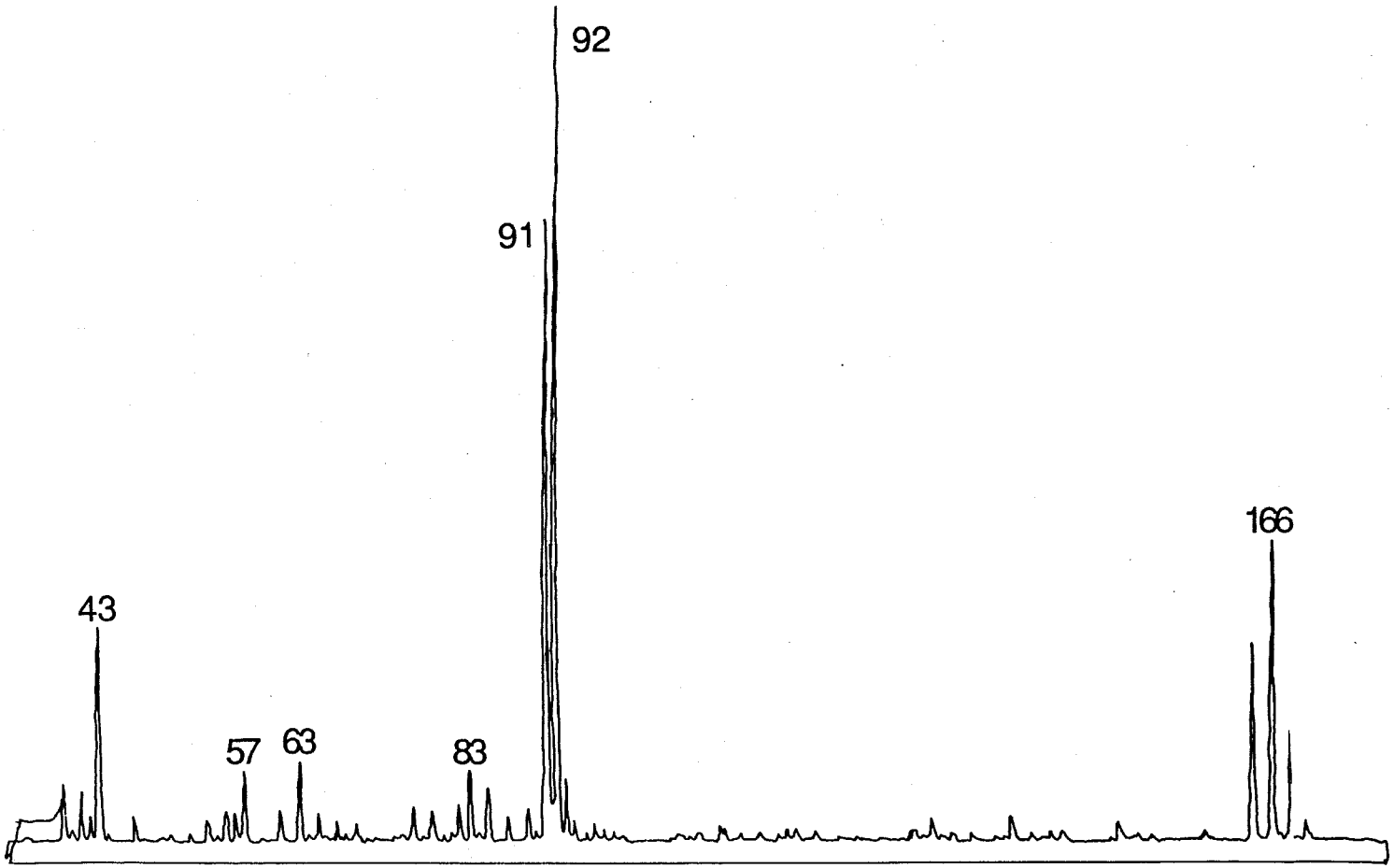
Figure 5:
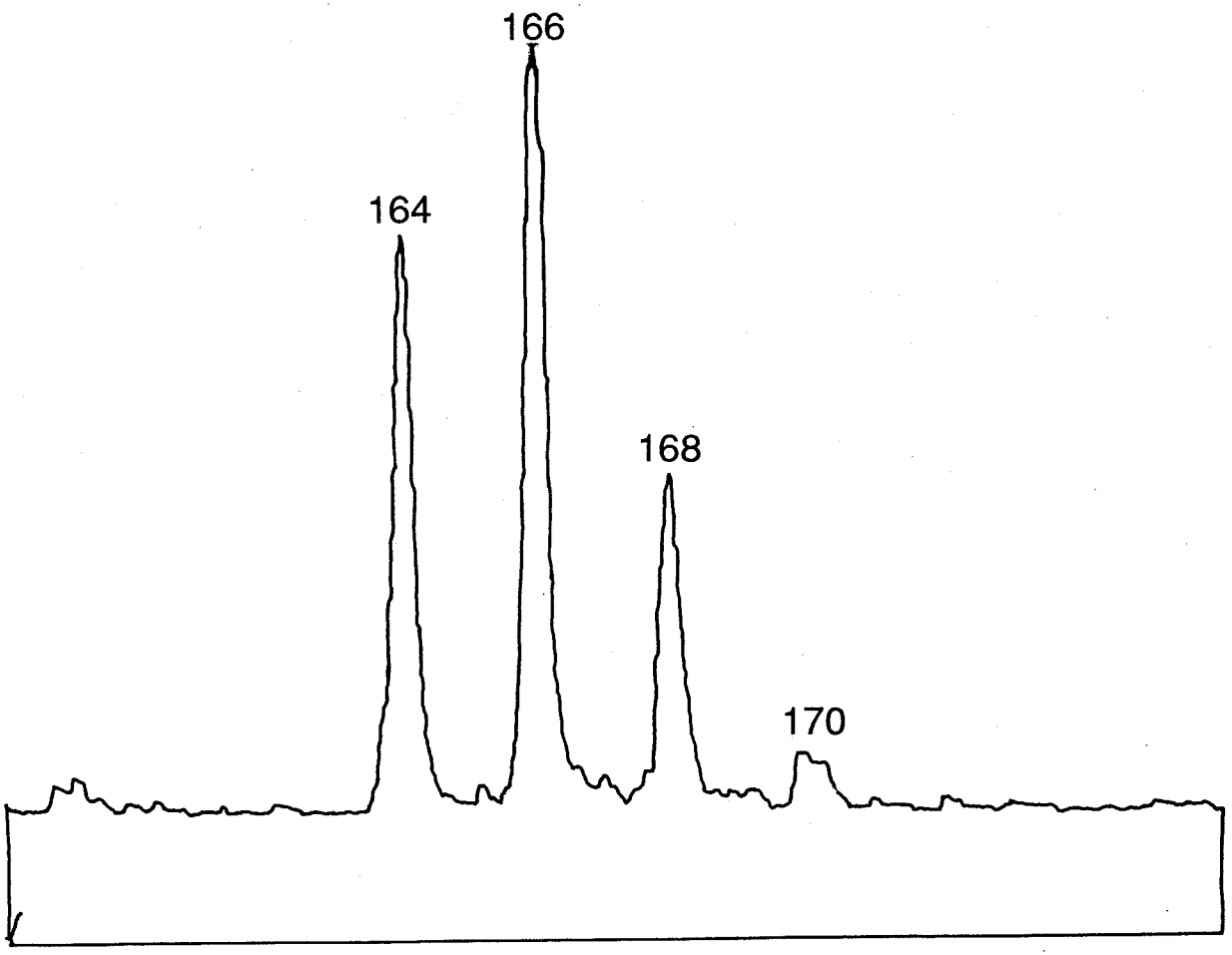
Figure 6:
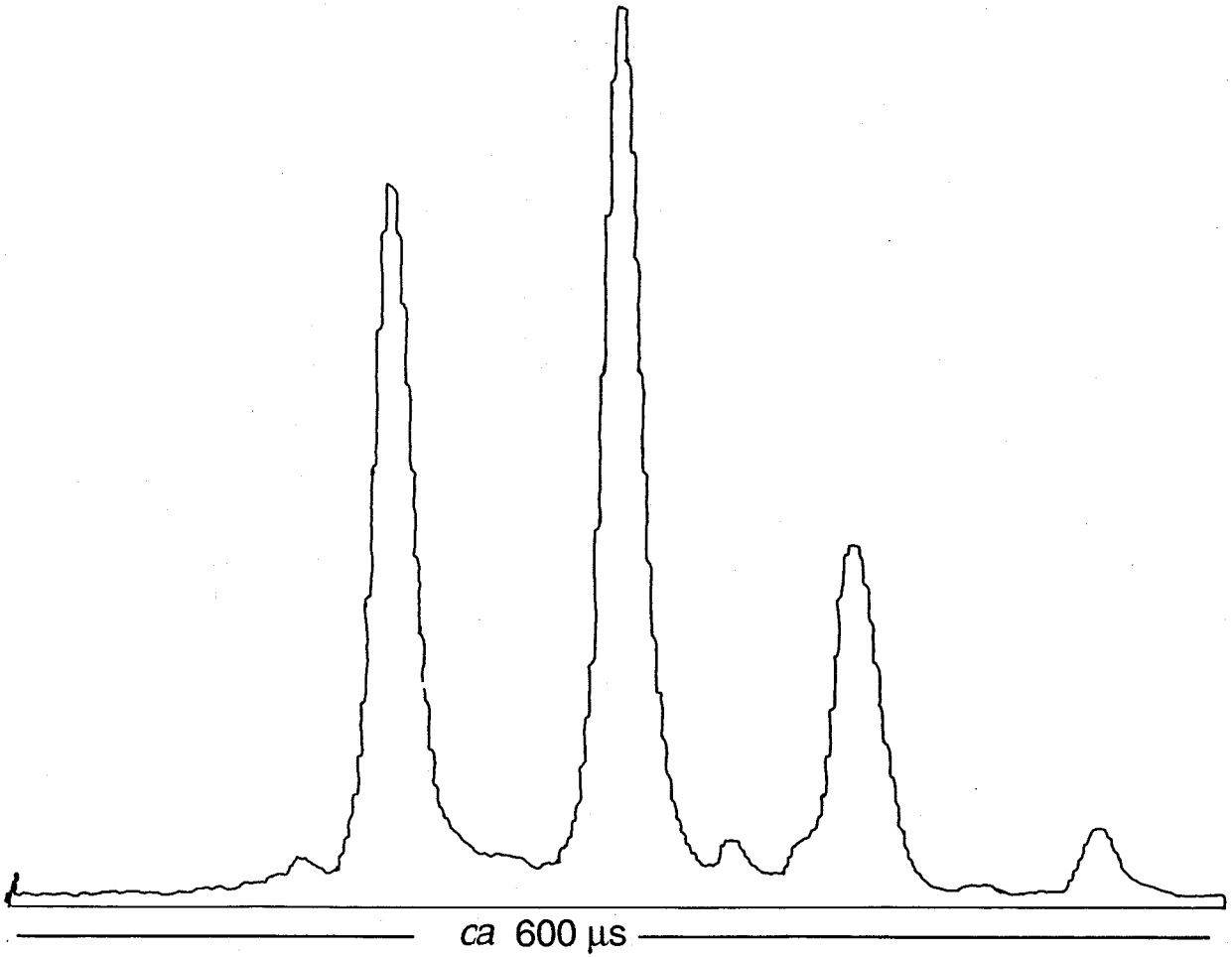

In practice, the triple-resonance scan sometimes exhibits a very bad peak shape which is caused by a beat between the exciting high frequency voltage, and a small fraction (in most cases $\frac{1}{3}$ or $\frac{1}{4}$) of the high frequency storing voltage. In this case, the electrodes of the QUISTOR can be formed with such a distance-corrected ratio Q of the radii that the resonance frequency of the secular ion movement coincides exactly with the fraction of the high frequency storage voltage. If the exciting high frequency voltage then is generated from the storage high frequency (e.g. by frequency division), the peak shape of the ions in the spectrum is excellent (FIGS. 4, 5, and 6).

Figure 7:
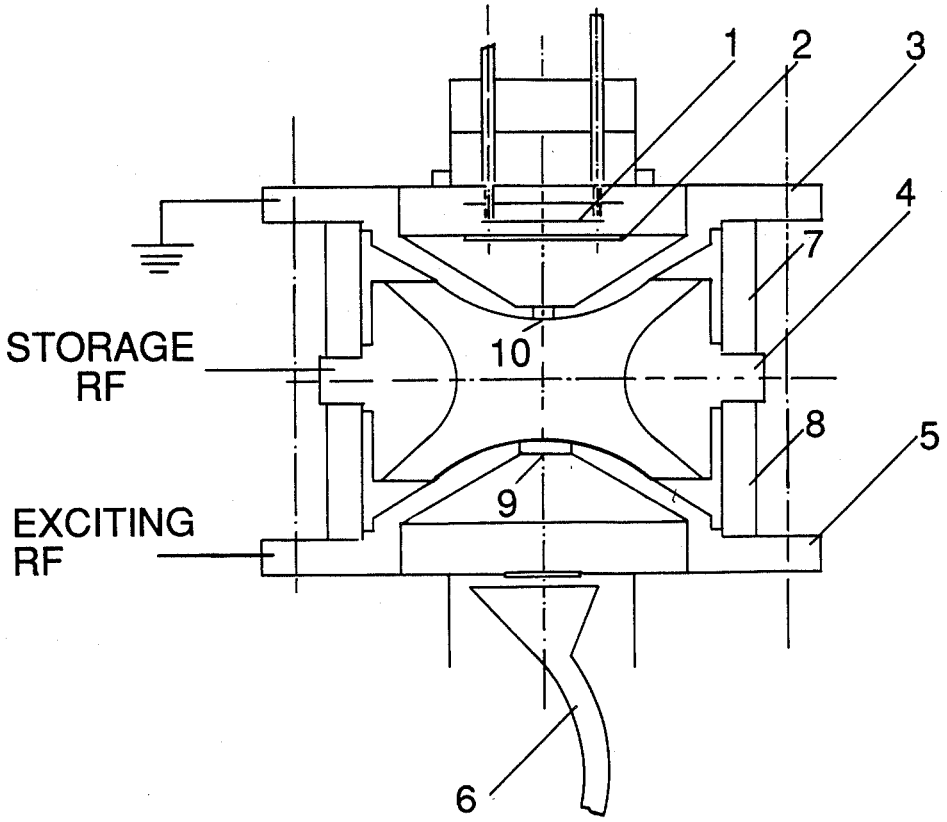

A best QUISTOR mass spectrometer (FIG. 7) can be designed by using a hyperbolically formed ring (4) and end electrodes (3), (5) with an angle 1:1.3784 of the hyperbole asymptotes, giving a Q=3.610. The electrodes are correctly spaced by insulators (7) and (8). The resonance frequency $f_{res,z}$ obeying the condition $$f_{res,z} + f_{res,r}\, f_{stor}/2,$$

matches exactly ⅓ of the storage high frequency $f_{stor}$.

Using a storage frequency of $f_{stor}$=1 MHz, the exciting frequency is $f_{exc}$=333.333 kHz. The latter can be advantageously generated from the oscillator which produces the frequency of the storage voltage, by a frequency division. The optimum voltage of the exciting frequency depends a little on the scan speed, and ranges from 1 Volt to about 20 Volts.

With an inner radius of the ring electrode (4) of $r_r$=1 cm, and with ions stored in the QUISTOR during a preceding ionization phase, a scan of the high frequency storing voltage $V_{stor}$ from the storage voltage upwards to 7.5 kV yields a spectrum up to more than 500 atomic mass units in a single scan.

Ions may be formed by an electron beam which is generated by a heated filament (1) and a lens plate (2) which focuses the electrons through a hole (10) in the end cap (3}into the QUISTOR during the ionization phase, and stops the electron beam during other time phases. During the scan period, ions are ejected through the perforations (9) in the end cap (5), and measured by the multiplier (6).

What is claimed is:

1. The method of mass analyzing a sample which comprises the steps of:

defining a three-dimensional electrical quadrupole storage field in which sample ions over the entire mass range of interest can be simultaneously trapped;

introducing or creating sample ions into the quadrupole field whereby ions within the mass range of interest are simultaneously trapped and perform ion-mass specific secular movements;

superimposing an exciting RF field with a frequency different from that of the storage RF field;

changing the superimposed fields so that simultaneously and stably trapped ions of consecutive masses encounter a resonance of their secular movements with the exciting RF field, take up energy, increase thereby the secular movement amplitudes, and leave the trapping field;

detecting the ions of sequential masses as they leave the trapping field; and providing an output signal indicative of the ion mass.

2. The method of claim 1 in which the storage field is generated by a QUISTOR of the type having a ring electrode and spaced end electrodes where the storage field is defined by U, $V_{stor}$, and $f_{stor}$, and the exciting field is defined by $V_{exc}$ and $f_{exc}$, and in which the superimposed fields are changed by one or more of U, $V_{stor}$, $f_{stor}$, or $f_{exc}$, where:

U=amplitude of DC voltage between the ring electrode and the end electrodes $V_{stor}$=magnitude of storage RF voltage between ring electrode and end electrodes $f_{stor}$=frequency of RF voltage $V_{exc}$=magnitude of exciting RF voltage between the two end electrodes $f_{exc}$=frequency of exciting RF voltage.

3. The method of claim 2 in which $f_{exc}$ is set constant, and essentially only $V_{stor}$ is changed.

4. The method of claim 3 in which the constant frequency $f_{exc}$ of the exciting field matches a sum or coupling resonance frequency arising from geometrical deviations of the storing field from the angle, 1:1.414 of the asymptotes, or from electrical deviations of the RF voltage from ideal sine waves.

5. The method of claim 4 in which said sum or coupling resonances of the secular movements of the ions are generated by geometrical deviations of the storing field introduced by deviations of the shape of the ring and end electrodes from the ideal hyperbolic form with angle 1:1.414 of the asymptotes.

6. The method of claim 5 in which the radii of the curved end electrodes and of the curved ring electrode, both defined in the points nearest to the field center, in order to generate the resonances of the secular movements obey the condition $$0.500 < Q < 3.990, \text{ where}$$

$$Q = \frac{R_e}{R_r} * \frac{r_0}{z_0}, \text{ where:}$$

$R_e$=radius of the end electrodes in the points nearest to the field center $R_r$=radius of the ring electrode in the points nearest to the field center $r_o$=smallest distance of the ring electrode from the field center $z_O$=smallest distance of the end electrodes from the field center.

7. The method of claim 5 in which the radii of the curved end electrodes and of the curved ring electrode, both defined in the points nearest to the field center, in order to generate the resonances of the secular movements obey the condition $$4.010 < Q < 25.0.$$

8. A method as in claim 4 in which the shape of the QUISTOR electrodes are chosen so that the coupling resonance frequency of the secular ion movements coincides with a low fraction 1/n (n=small integer number greater then 2) of the storage frequency, and in which the excitation voltage with frequency $f_{exc}=f_{stor}/n$ is coupled in frequency and phase to the storage voltage with frequency $f_{stor}$.

9. A method as in claim 8 in which n=3.

10. A method as in claim 1 in which the scanning speed for the parameters of the superimposed fields is chosen such that the shift of the secular frequency with increasing amplitude, caused by an anharmonic storage field, is at least partially compensated by an inverse shift of the secular frequency caused by the parameter scanning itself.

* * * * *